United States Patent [19]

Guttormsem

[11] Patent Number: 4,817,220

[45] Date of Patent: Apr. 4, 1989

[54] HEIGHT ADJUSTING MECHANISM FOR A PHYSICAL THERAPY BENCH

[75] Inventor: Rolf Guttormsem, Skien, Norway

[73] Assignee: A/S SABA Medical, Oslo, Norway

[21] Appl. No.: 88,541

[22] Filed: Aug. 20, 1987

Related U.S. Application Data

[63] Continuation of Ser. No. 921,700, Oct. 22, 1986, abandoned.

[30] Foreign Application Priority Data

Oct. 24, 1985 [NO] Norway ..... 854267

[51] Int. Cl.[4] ..... A61G 7/00; A47C 31/00

[52] U.S. Cl. ..... 5/63; 5/11; 108/145; 248/421; 254/122; 254/124

[58] Field of Search ..... 5/63, 65, 11; 269/322–325; 248/421; 108/145; 254/122, 124

[56] References Cited

U.S. PATENT DOCUMENTS

| | | | |
|---|---|---|---|
| 836,397 | 11/1906 | McGough | 5/63 |
| 2,870,460 | 1/1959 | Sanford | 5/63 |
| 3,174,722 | 3/1965 | Alm | 5/63 X |
| 3,743,344 | 7/1973 | Jameson | 5/63 X |
| 3,760,436 | 9/1973 | Zach et al. | 5/63 X |
| 3,991,428 | 11/1976 | Hanson | 5/63 |
| 4,078,269 | 3/1978 | Weipert | 5/63 |

FOREIGN PATENT DOCUMENTS

| | | | |
|---|---|---|---|
| 949703 | 6/1974 | Canada | 5/63 |
| 1552596 | 9/1979 | United Kingdom | 5/63 |

*Primary Examiner*—Alexander Grosz
*Attorney, Agent, or Firm*—Staas & Halsey

[57] ABSTRACT

A height adjusting mechanism for a physical therapy bench has great lifting height due to levers extending at an angle with each other in one end position which are made to coincide approximately midway in their movement, said movement being permitted to continue in said levers passing each other and in their other end position again extending at an angle with each other.

3 Claims, 1 Drawing Sheet

HEIGHT ADJUSTING MECHANISM FOR A PHYSICAL THERAPY BENCH

Figure 1:
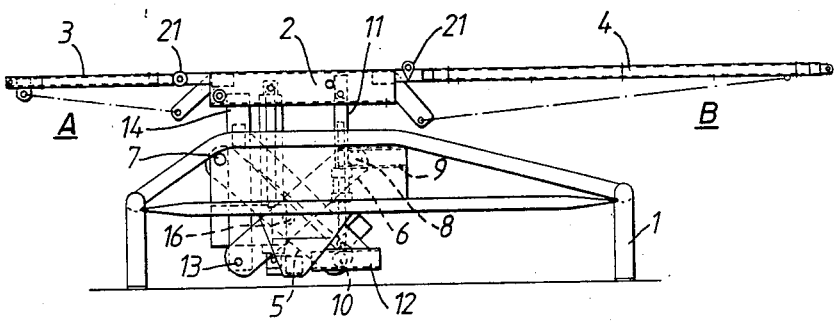

This is a continuation of application Ser. No. 921,700, filed on Oct. 22, 1986, now abandoned.

The present invention relates to a height adjusting mechanism a worktable. In this context worktables are especially considered to be benches for physical therapy, hospital beds and similar devices often necessitating change of the height, e.g. from one patient to another who is to receive physical therapy.

There are a large number of mechanisms for lifting and lowering worktables, but they all have the disadvantage that they are very bulky, as seen in relation to the lifting distance, i.e. the difference between the lowermost and uppermost positions of the worktable that may be needed in each individual case. For benches for physical therapy, being a typical example here, a difference of 40 to 100 cm may be required between the lowermost position and the uppermost position, dependent on the treatment each individual patient is to receive. With the previously known approaches comprising levers, screw mechanisms, and the like, the length of the separate members is big enough to fill almost the entire space below the worktable. With many worktables it does not matter that the lifting and lowering mechanism fills the entire space at disposal below the table. However, in the case of workbenches for physical therapy and other kinds of worktables, where it may be necessary to adjust the flap or drop leaf of the table at various angles, this may be prevented by the lifting and lowering mechanism below the table. Especially in the case of benches for physical therapy it is, thus, a requirement that it should be possible to clear the space below one or both ends of said bench to permit various portions of said bench to be turned down when a patient has to repose in a certain position during treatment.

In order to be able to assemble said lifting and lowering mechanism in such a manner between the frame resting on the support and the bench itself said mechanism must be designed to permit maximum utilization of the possible movement of each separate member of the lifting and lowering mechanism. Today, it presents no difficulties to construct a lifting and lowering mechanism having the desired lifting height if a large number of levers is used, but, as mentioned, this is a bulky approach, and it is, thus, an object of the present invention to provide a lifting and lowering mechanism permitting the desired lifting height by the aid of components and members that are, in most cases, necessary anyway to achieve a satisfactory support of the worktable or bench if the worktable is to be used for physical therapy.

According to the invention this is achieved by the aid of a simple lifting and lowering mechanism including two members in the shape of levers that are movably connected in a point between their ends and adapted in such a manner as regards dimensions that one end of a lever may move past the end of the other lever. Each lever is at one of its ends mounted by a pivot point that does not change the level of its position within the frame. Due to said passing possibility said arms may move in such a manner about said two pivot points that the center lines of said arms, when they are in the lower position, will point at an angle downwards from a line through said pivot points and, when they are in the upper position, will point upwards from said line. In this design the same members of the lifting and lowering mechanism result in a roughly doubled lifting height of what would have been possible with a lifting and lowering mechanism of the same structure, but with the previously known limitation on leaf adjustment.

Figure 2:
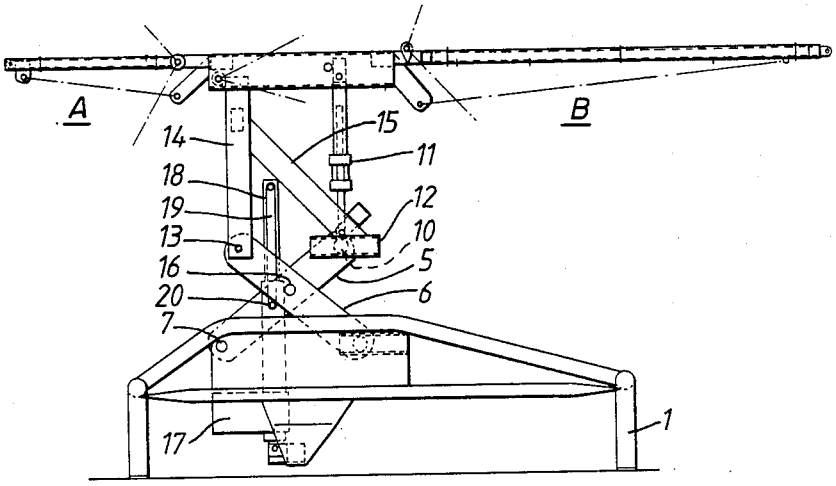

The invention is characterized by the features stated in the claims and is disclosed in more detail below with reference to the drawings, where FIGS. 1 and 2 show a bench for physical therapy in its lower and upper positions, respectively.

Said bench for physical therapy includes a bottom frame 1 and a top frame 2 supporting the bench itself. Said bench has adjustable leaves 3 and 4 which are adjusted dependent on the treatment that each individual patient is to receive. Between top frame 2 and bottom frame 1 the lifting and lowering mechanism according to the present invention is provided. In the shown embodiment said mechanism includes two levers 5 and 6 with lever 5 pivoted in a point 7 that is stationary in bottom frame 1. Lever 6 is, in the same manner, pivoted in a point 8, but this pivot point is movable horizontally in a guide or coulisse 9. Lower end of lever 5 (FIG. 1; it will be upper end in FIG. 2) is correspondingly pivoted in point 10 of a support 11. Point 10 is movable horizontally in a guide or coulisse 12, whereas lower end of lever 6 in point 13 is pivotally connected with an intermediate frame 14 supporting the workface of the bench with support 11. The length of support 11 is adjustable for adjustment of the top frame 2 angle. Intermediate frame 14 includes an inclined brace 15, the lower end of which carries the guide or coulisse 12 for pivot point 10.

Levers 5 and 6 are pivotally connected with each other at a point 16 between lever ends. In bottom frame 1 a power unit 17 is provided which may be electric, hydraulic, pneumatic or a combination thereof. The power unit 17 is provided with a telescopically movable rod 18 connected with a link 19 at its outside end. Said link 19 is at its opposite end pivotally connected with lever 5 at a point 20 having such a distance from pivot point 7 of said lever that the working stroke for which power unit 17 is constructed will result in arm 5 turning around pivot point 7 from the position shown in FIG. 1 to the position shown in FIG. 2. The movement of lever 5 by the aid of power unit 17 from its lower position (FIG. 1), i.e. counterclockwise, will cause pivot point 16 between levers 5 and 6 to lift which, in turn, will cause point 8 at one end of lever 6 to slide towards the right hand side in FIG. 1 in the coulisse or guide 9, and point 13 at the opposite end will rise and lift bench table 2, 3, 4.

The embodiment of the invention disclosed here is shown as an example and is distinguished by the fact that the distance from the common point 16 of levers 5 and 6 to pivot points 10 and 13, respectively, is so much shorter than the distance from said common point 16 to pivot points 7 and 8, respectively, that the levers may pass inside one another, i.e. that pivot point 13 of arm 6 will pass inside pivot point 7 of arm 5, and pivot point 10 of arm 5 will, in the same manner, pass inside pivot point 8 of arm 6. The levers will, thus, be able to continue moving upwards about pivot points 7 and 8 from said substantially horizontal position and further upwards to the position shown in FIG. 2.

It will now be obvious that since the entire necessary lifting movement may be produced by levers 5 and 6, said lifting and lowering mechanism can be assembled in a very limited area below the bench table 2, 3, 4 leaving areas A and B bleow leaves 3 and 4 clear and enabling leaves 3 and 4 to be turned down about hinge members 21. These possibilities of adjustment are very limited in benches for physical therapy where the lifting and lowering mechanism occupies more of the space at disposal below the table when it is necessary to use a more complicated lifting and lowering mechanism to achieve the desired height.

It should be mentioned here that the shown bench for physical therapy is an example of utilization of the present invention and the invention can obviously be used in other fields with the same advantage, e.g. on a hospital bed where the resting surface is arranged in its lower position when a frail patient tries to get into or out of bed alone, whereas it is arranged in its upper position to facilitate the necessary task of the hospital staff. In case of hospital beds it is also important that the mechanism has a simple structure. It will, then, be more easy to clean and to disinfect occasionally.

The invention may also be used in industry to support mounting tables, machinery, and other production equipment, where a large lifting height, as compared with the dimensions of the lifting and lowering mechanism, is required.

Having described my invention, I claim:

1. An adjustable physical therapy bench, comprising:

(a) a first, bottom frame;

(b) a second, upper frame including adjustable leaves;

(c) a third, intermediate frame located between the first and second frames and being attached to the second, upper frame;

(d) a height adjustment mechanism operatively connected between the first, second and third frames, including:

first and second substantially equal length levers pivotally connected to each other between the ends thereof, the first lever also being pivotally connected at a first end to the first, bottom frame and, at a second end, pivotally and slidably connected to a support connected to the second, upper frame, the second lever also being pivotally connected at a first end to the intermediate frame and, at a second end, pivotally and slidably connected to the first, bottom frame, wherein, the second upper frame is movable between a first position with the first lever angled downward relative to the pivot point at the first end thereof and the second lever angled upwardly relative to the pivot point at the first end thereof, and a second position with the first lever angled upwardly relative to the pivot point at the first end thereof and the second lever angled downwardly relative to the pivot point at the first end thereof; and (e) power means pivotally connected to the first lever, wherein, when the second upper frame is in the first position and the power means is activated, the first lever is caused to rotate counterclockwise relative to the pivot point at the first end thereof, the second lever pivots relative to the first lever and is caused to rotate clockwise relative to the pivot point at the first end thereof, the first and second levers temporarily move into a copalnar relationship and then continue to rotate past each other, thereby moving the second, upper frame to the second higher position.

2. The bench as recited in claim 1, further comprising a brace connected between the intermediate frame and the second end of the second lever.

3. The bench as recited in claim 1, wherein the power means is connected to the height adjustment mechanism by a rod and link mechanism.

* * * * *